United States Patent [19]

Hull et al.

[11] Patent Number: 4,993,987

[45] Date of Patent: Feb. 19, 1991

[54] DOLL WITH PHOTO IMAGE FACE

[76] Inventors: Harold L. Hull, 401 Canyon Way, SP. 43, Sparks, Nev. 89434; Karen K. Joslin, 23656 Via Avant, Valencia, Calif. 91355

[21] Appl. No.: 402,462

[22] Filed: Sep. 1, 1989

[51] Int. Cl.[5] ..... A63H 3/00

[52] U.S. Cl. ..... 446/268; 446/372; 446/391

[58] Field of Search ..... 446/369, 309, 372, 391, 446/100, 385, 268; 8/470, 471

[56] References Cited

U.S. PATENT DOCUMENTS

| | | | |
|---|---|---|---|
| 833,448 | 10/1906 | DeVall | 446/391 X |
| 2,199,049 | 10/1938 | Greenberg | 446/100 |
| 3,966,396 | 6/1976 | Howes et al. | 8/471 |
| 4,020,586 | 5/1977 | Benner | 446/321 X |
| 4,659,319 | 4/1987 | Blair | 446/391 X |

FOREIGN PATENT DOCUMENTS

| | | | |
|---|---|---|---|
| 63186 | 6/1913 | Switzerland | 446/391 |
| 22825 | of 1909 | United Kingdom | 446/369 |

*Primary Examiner*—Mickey Yu

[57] ABSTRACT

A doll having a personalized, photographic face such as mother's face, impregnated in the material of which the doll is constructed.

2 Claims, 1 Drawing Sheet

DOLL WITH PHOTO IMAGE FACE

BACKGROUND OF THE INVENTION

This invention relates to toys and more particularly to dolls including a photographic likeness of a person impregnated in the face and/or body of the doll.

It is known to provide a doll which has a photographic image of the face of a person affixed to the doll's face portion such as patent #2,199,049 issued to A. D. Greenburg. This prior art simply affixed a photograph to the face of a doll which can easily be torn off or changed. Also, patent #4,020,586 teaches a sleeve or transparent protective covering for a photograph and is designed for removing and changing the photograph.

Many variations of faces on dolls have been taught as a doll is the largest selling single toy in the world, however, no provision has been made for impregnating in the fabric or construction material the actual photographic likeness, other than by silkscreening, of an individual person which cannot be changed without marring the material of the doll.

One of the reasons for not impregnating the cloth with a photographic likeness in the past is due to the cost of reducing a photograph to multiple silkscreens which has made it impractical to individualize each doll. New technology has now been developed which overcomes this objection.

Also, the prior art shows photographs being used for the face which are flat and two-dimensional which is un-realistic in appearance when placed on a three dimensional doll.

SUMMARY OF THE INVENTION

It is a primary object of the present invention to provide a doll which has a photographic likeness of a face impregnated in the cloth, fabric or other material of which the doll is made in such a manner as to make it part of the doll so that the face cannot be readily changed.

It is a further object to provide a doll which may be used as a security or identifying means when leaving a child at a nursery school and the doll has the likeness of the mother or other person who regularly picks up the child. So that if some other person attempts to pick up the child the persons in authority can compare the photographic image on the doll with the person picking up the child.

It is still another object to provide a doll with the photographic likeness of a parent or other loved one which can give comfort to the child.

It is yet another object to provide a means to build a "family" of dolls that a child can identify with, that represent realistic photographic images of persons known to the child.

It is another object to provide a doll that has a photographic image of the child to show the growth of the child at various stages of his or her life, thus preserving for posterity the lifelike image of the child.

Other objects and advantages will become more apparent during the course of the following description when taken in connection with the accompanying drawings.

DETAILED DESCRIPTION OF THE PREFERRED EMBODIMENT

Figure 1:
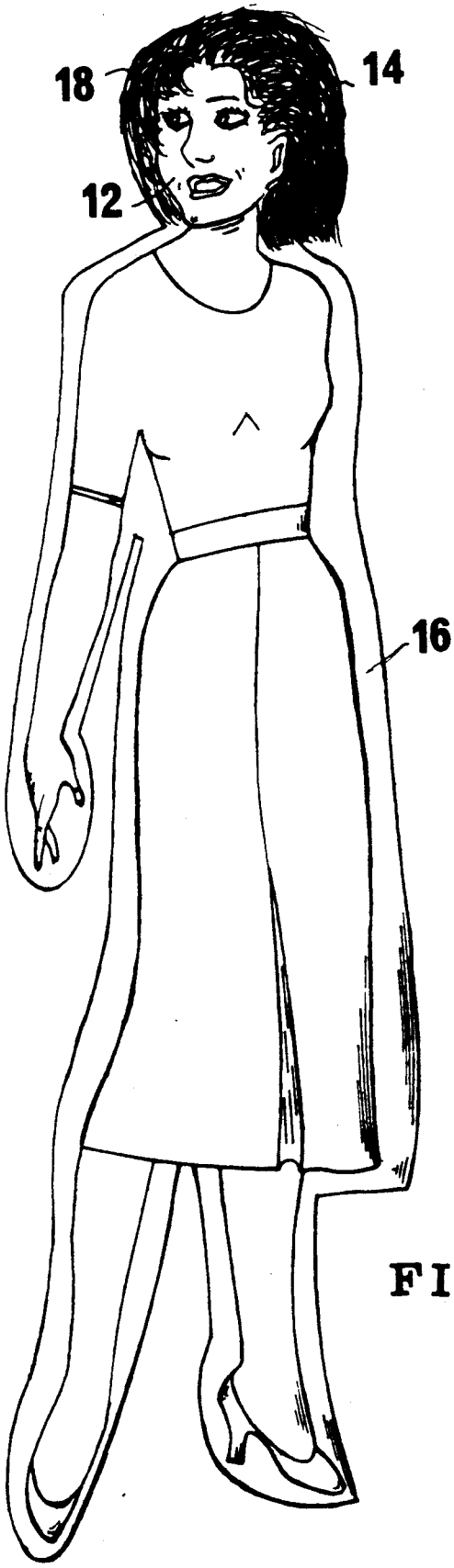
FIG. 1 is a perspective view of a doll with a photographic face impregnated in the fabric.
Figure 2:
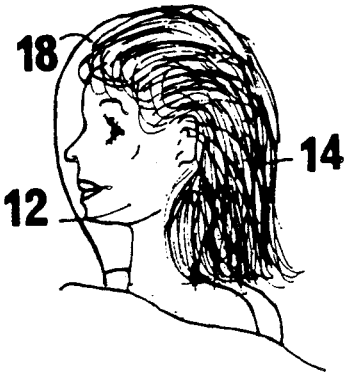
FIG. 2 is a side view showing the three dimensional contour of a face.

Referring now to the drawings, wherein like reference characters designate like or corresponding parts throughout the views, a doll includes a body portion 16, a head 18 with a face 12 and simulated hair 14 made from a mass of thread or yarn or the like.

The doll is constructed of material such as cloth or the like which can be impregnated by a printing process such as SUBLIMATION which is a printing process using heat cured inks. Using a matrix scanner, color photos or drawings are scanned for the three basic colors, yellow, red, and blue. A stencil is electronically cut for each of the basic colors. Using an offset printer, each of the stencils are ran through, using the sublimation ink corresponding to the color of each stencil, yellow stencil-yellow ink and so on. When a single piece of paper is ran through the printer three times, the paper will have a coating of each color. The image will appear at first to be yellow, then as the paper is ran through the red ink, the image will appear slight rust color. As the paper is passed through the blue ink the image will appear lifelike in colors. By passing the paper through the printer three times the overlay of the inks will produce most colors of the color spectrum. The scanner picks up the various shades of color and cuts the stencil at various degrees for each color. When the three stencils are combined, each having various degrees of cutting, they together produce a reproduction of the original. Using the printed paper as a transfer, the print is heat pressed to the material at approximately 400 degrees. The process, because it uses heat cured inks, dyes the material it is applied to, unlike silk-screening which merely applies ink to the surface of the material. Depending upon the material used the print will not fade with washing, and will not crack or peel under any circumstances.

By this or a similar process it is possible to produce a photographic likeness of a person's face and/or body on cloth or the like from which a doll can be made which cannot be removed from the doll as the photographic image is now part of and impregnated in the material.

The doll embodying this invention now provides a realistic, three-dimensional, photographic reproduction of a desired person such as a mother which may be used for security purposes as the features cannot readily be changed as in the prior art, and which can provide comfort and realistic companionship to the child, or provide a chronological history of the child if several dolls are made at different times in the child's life.

Although the inVention has been herein shown and described in what is conceived to be the most practical and preferred embodiments, it is recognized that departures may be made therefrom within the scope of the invention, which is not to be limited to the details disclosed herein but it is to be accorded the full scope of the claims so as to embrace any and all equivalent devices and apparatus.

Having described our invention, what we claim as new and desire to secure by letters patent is:

1. A method of making and using a doll having a facial image of a person related to and recognizable by a child player of the doll, the steps comprising;

a. taking a photograph of said person;

b. constructing a doll with a blank face portion made of a material impregnatable by heat cured inks in a photographic printing process;

c. printing said photograph with heat cured inks on said doll by a photographic printing process to define a doll face having the facial image of said person;

d. providing said doll having said facial image to said child player; and e. comparing the face of said person with said doll face to determine a match.

2. The method of claim 1 wherein said photographic printing process is a sublimation process.

* * * * *